US006126425A

United States Patent [19]

Fukui

[11] Patent Number: 6,126,425

[45] Date of Patent: Oct. 3, 2000

[54] POSITIVE DISPLACEMENT PUMP

[75] Inventor: Kiyozumi Fukui, Tokyo, Japan

[73] Assignee: T. D. Engineering Co., Ltd., Fuwa-gun, Japan

[21] Appl. No.: 09/080,644

[22] Filed: May 18, 1998

[30] Foreign Application Priority Data

May 22, 1997 [JP] Japan ..... 9-132074

[51] Int. Cl.[7] ..... F01C 21/04

[52] U.S. Cl. ..... 418/83; 418/201.1

[58] Field of Search ..... 418/83, 201.1

[56] References Cited

U.S. PATENT DOCUMENTS

| | | | |
|---|---|---|---|
| 1,590,964 | 6/1926 | Street | 418/83 X |
| 3,923,433 | 12/1975 | Hermes et al. | 418/83 |
| 3,937,602 | 2/1976 | Sharples | 418/83 |
| 3,950,116 | 4/1976 | Sharples | 418/83 |
| 4,158,531 | 6/1979 | Ito | 418/83 |
| 4,228,654 | 10/1980 | Hill . | |
| 5,533,566 | 7/1996 | Fineblum . | |

FOREIGN PATENT DOCUMENTS

| | | |
|---|---|---|
| 0 451 708 A2 | 10/1991 | European Pat. Off. . |
| 2 488 345 | 2/1982 | France . |
| 30 22 147 A1 | 1/1982 | Germany . |
| 61-65087 | 4/1986 | Japan . |
| 821947 | 10/1959 | United Kingdom . |

*Primary Examiner*—Hoang Nguyen
*Attorney, Agent, or Firm*—Akin, Gump, Strauss, Hauer & Feld, L.L.P.

[57] ABSTRACT

A positive displacement pump is provided which is high both in reliability and in durability being durable in a continuous operation for a long period of time with the suction side of the pump temperature-controlled. In the positive displacement pump, rotors (21, 22) are accommodated in a pump housing (10) to form a plurality of operating chambers (31, 32), in such a manner that the operating chambers (31, 32) are increased on the suction side and decreased on the discharge side. A temperature control system (40) for controlling the temperature (12) of the suction inlet (12) of the pump is provided.

8 Claims, 4 Drawing Sheets

POSITIVE DISPLACEMENT PUMP

BACKGROUND OF THE INVENTION

This invention relates to positive displacement pumps, and more particularly to a positive displacement pump which is high in durability being operable continuously for a long period of time, and high in operating reliability.

A root type, claw (phonetic) type, and screw type vacuum pumps are known as positive displacement pumps, and especially as vacuum pumps in the art which are used for evacuation to obtain a low pressure work space. The positive displacement pump must be high in reliability and in durability, being durable in a continuous operation for a long period of time.

A positive displacement pump of this type has been disclosed, for instance, by Japanese Patent Appl cation (OPI) No. 65087/1986 (the term "OPI" as used herein me ns an "unexamined published application"). In the pump, a multi-male thread type rotor, and a multi-female type rotor (which is opposite in the direction of thread) are arranged in parallel with each other in a pump housing, in such a manner that a plurality of shiftable spiral operating chambers are formed between the pump housing and the two rotors. When the two rotors are turned in the opposite directions on the side of one end of the pump (as viewed in the direction of axis of the rotor) which corresponds to the shift start position, the volume communicated with the suction inlet increases, thus performing a gas suction. As a result, the operations chambers having a predetermined volume which have achieved the gas suction are shifted one after another to the side of the other end as viewed in the direction of axis. On the other hand, on the side of the other end (as viewed in the direction of axis of the rotor) which corresponds to the shift end position, the volume which is communicated with discharge outlet decreases, so that the gas in the operating chambers is discharged. The vacuum pump is employed as a multi-stage pump in a semiconductor manufacturing apparatus. In this case, the pump must be high in reliability and in durability for a continuous operation for a long period of time discharging a reactive gas from the semiconductor manufacturing apparatus.

In the above-described positive displacement pump, the pressure of the fluid in the operating chambers increases on the discharge side. Hence, the discharge side becomes high in temperature, while the temperature of the gas suction side is not increased so much. Therefore, the pump suffers from the following difficulties:

In a semiconductor manufacturing process; more specifically, in a process of forming a film by CVD (chemical vapor deposition) for instance, several kinds of gases are supplied to a processing chamber to form the film by chemical reaction. When, during this treatment, the reaction gases are discharged from the treatment chamber with the vacuum pump, solid products stick and deposit on the side of low temperature of the vacuum pump; that is, on the suction side, which makes it difficult for the pump to operate satisfactorily. That is, although the vacuum pump must be so high both in durability and in reliability to the extent that it is operable for a long period of time such as for instance at least one year, it is necessary to overhaul the pump every several months. That is, the conventional vacuum pump is not high enough both in durability and in reliability.

SUMMARY OF THE INVENTION

In view of the foregoing, an object of the invention is to provide a positive displacement pump in which the temperature on the suction side of the pump is controlled to maintain the temperatures of the whole shift interval of the operating chambers at a value with which solid materials are scarcely stuck thereto, thus being high in durability—durable in a long continuous operation—and high in reliability.

The foregoing object of the invention has been achieved by the provision of a positive displacement pump comprising:

a pump housing having an internal chamber, and a suction inlet and a discharge outlet which are communicated with the internal chamber; and rotors which are accommodated in the pump housing, forming shiftable operating chambers with the pump housing, in such a manner that the operating chambers are increased in volume in a shift interval which communicates with the suction inlet, and decreased in volume in a shift interval which communicated with the discharge outlet; in which, according to the invention, a temperature control system for controlling the temperature on the side of the suction inlet is provided. Hence, on the suction side of the pump, the setting of temperature can be avoided so that, for instance, reaction gas may stick solid products thereto.

The aforementioned temperature control system may be a system for heating the vicinity of the suction inlet. However, preferably it is a heat transmitting system which is provided for the pump housing and/or the rotors to transmit heat from the vicinity of the discharge outlet to the vicinity of the suction inlet. With this system, the heat which is produced by heat insulation compression in the operating chambers on the discharge side (hereinafter referred to as "compression heat", when applicable) can be utilized; that is, it is unnecessary to supply energy from outside.

In view of maintenance and reliability, the aforementioned heat transmitting system is preferably provided in the peripheral wall of the pump housing which surrounds the operating chambers. For instance, heat pipes may be buried in the pump housing, or the convection or circulation paths of the fluid high in thermal conductivity are formed in the pump housing, to form the heat transmitting system with ease. Furthermore, the compression heat on the discharge side can be transmitted to the suction side with high efficiency.

The aforementioned rotor may be made up of a male-threaded rotor and a female-threaded rotor which are arranged in parallel with each other and are adjacent to each other, so that the fluid in the operating chambers is shifted in the direction of axis of the rotor. In this case, the heat transmitting system (heat pipes) may be employed which are extended in the direction of axis of the rotor. In the case where the aforementioned rotor is employed as a pump in which the operating chambers are shifted around the axis of rotation of the rotor as in the case of a root type pump or the like, the heat transmitting system may be employed as follows: That is, in the case where the pump is not a multi-state pump in which the pumps are juxtaposed in the direction of axis of the rotor, the heat transmitting system which is extended in the direction of rotation of the rotor can be employed; and in the case where the aforementioned multi-state pump is employed, the heat transmitting system which is extended in the direction of axis of the rotor may be employed.

DETAILED DESCRIPTION OF THE PREFERRED EMBODIMENTS

Preferred embodiments of the invention will be described with reference to the accompanying drawings.

First Embodiment

Figure 1:
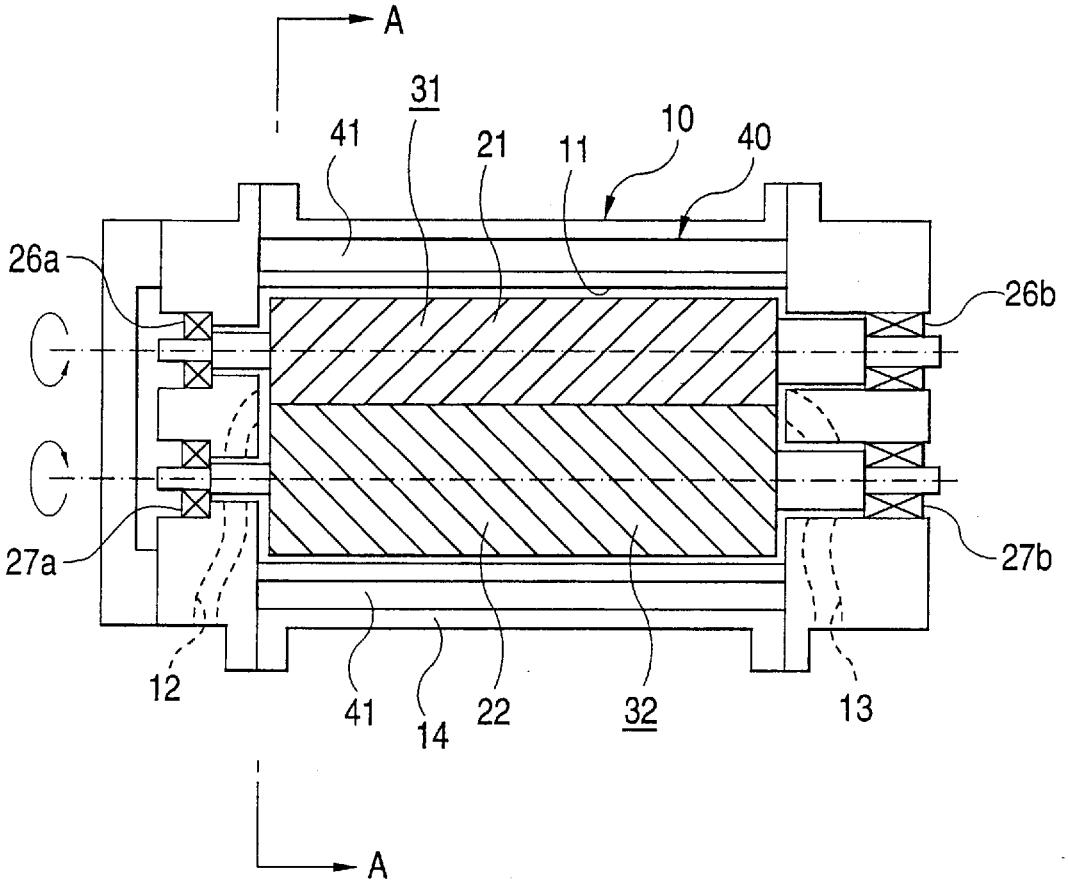
FIG. 1 is a sectional front view showing the arrangement of an example of a positive displacement pump, which is a first embodiment of the invention.
Figure 2:
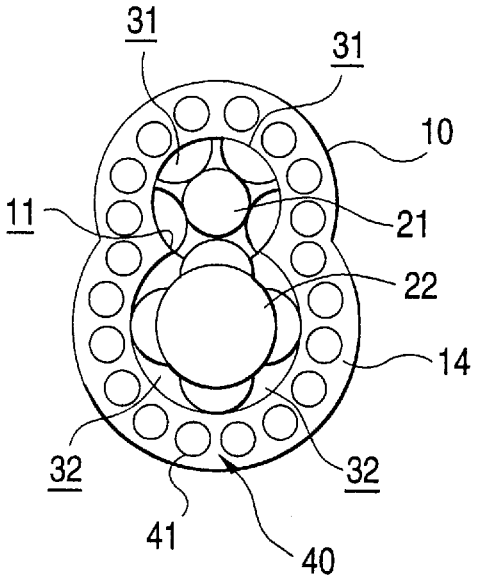
FIG. 2 is a sectional view taken along line A—A in FIG. 1.

FIGS. 1 and 2 are diagrams showing an example of a positive displacement pump, which is a first embodiment of the invention.

In FIGS. 1 and 2, reference numeral 10 designates a pump housing. The pump housing 10 includes an inner chamber 11, and a suction inlet 12 and a discharge outlet 13 which are communicated with the inner chamber 11. The suction inlet 12 is connected to a chamber which is to form a film, for instance, by a CVD (chemical vapor deposition) method, to discharge gas out of the chamber.

Reference numerals 21 and 22 designate rotors which are accommodated in the pump housing 10 with a predetermined clearance (for instance about 50 $\mu$m) between them. The rotor 21 is formed female-threaded, while the rotor 22 is formed male-threaded. Those rotors 21 and 22 are engaged with each other with a predetermined engagement clearance. The rotors 21 and 22 are set parallel to each other to the pump housing 10 with the aid of bearings 26*a*, 26*b*, 27*a* and 27*b*, and between the pump housing 10 and the rotors 21 and 22 a plurality of shiftable spiral operating chambers 31 and 32 are formed. As the rotors 21 and 22 rotate around the axes of rotation which are in parallel with each other, the operating chambers 31 and 32 are moved in the directions of axes of the rotors together with the fluid therein. When the rotors 21 and 22 rotate, the operating chambers 31 and 32 perform a suction action increasing the volume to a predetermined value in the interval of displacement, on the suction side, which is communicated with the suction inlet 12; and the displacement is effected with the constant volume in the intermediate interval which is not communicated with the suction inlet 12 nor the discharge outlet 13; and the discharge action is performed with the volume decreased in the interval of displacement, on the discharge side, which is communicated with the discharge outlet 13.

The pump according to the invention has a temperature control system for controlling the temperature difference in a predetermined range which is between the operating chambers 31 and 32 located on the side of the suction inlet 12 and the operating chambers 31 and 32 located on the side of the discharge outlet 13. The temperature control system 40 is, for instance, made up of a plurality of heat pipes 41 (a heat transmitting system) which are extended in the directions of axes of the rotors 21 and 22. Those heat pipes 41 are provided in at least one of the pump housing 10 and the rotors 21 and 22 (for instance, in the peripheral wall 14 of the pump housing 10 surrounding the operating chambers 31 and 32 in this embodiment). The heat pipes thus provided are to transmit the heat from the vicinity of the discharge outlet 13 of the pump housing to the vicinity of the suction inlet 12. A predetermined liquid is poured into each of the heat pipes 4 the insides of which are decreased in pressure (vacuumed). When heated, the liquid is vaporized at one end and is allowed to flow to the other end, where its heat is radiated to form the liquid. The liquid thus formed is returned to the one end by capillary action.

The positive displacement pump according to the embodiment functions as follows: When the rotors 21 and 22 rotate, and, on the side of the discharge outlet 13, the operating chambers are decreased in volume, the compression heat (diabatic compression heat) of the fluid in the operating chambers 31 and 32 is produced, so that the vicinity of the discharge outlet 13 becomes high in temperature. Under this condition, the heat pipes 41 transmit the heat from the vicinity of the discharge outlet 13 of the pump housing 10 to the vicinity of the suction inlet 12; that is, while the vicinity of the discharge outlet 13 is cooled, the vicinity of the suction inlet 12 is heated, whereby the temperature difference between the side of the suction inlet 12 and the side of the discharge outlet 13 is decreased.

Furthermore, in the above-described embodiment, in order that, for instance, the temperature reaches a value with which it is difficult for the reactive gas entering the operating chambers 31 and 32 from the aforementioned low pressure chamber to form solid product (for instance, higher than 200° even in the vicinity of the suction inlet 12); that is, in order to avoid a temperature range (for instance, lower than 100°) with which solid product is liable to be formed in the operating chambers 31 and 32, the temperature in the vicinity of the suction inlet 12 of the pump housing 10 is controlled high (higher than 150°). This eliminates the difficulty accompanying the prior art that solid product sticks and stacks in the pump housing whereby the operation must be stopped in several months.

The temperature control system 40 is made up of the heat pipes 41 adapted to transmit the heat from the vicinity of the discharge outlet 13 to the vicinity of the suction inlet 12. Therefore, the compression heat on the side of the discharge outlet can be utilized, which makes it unnecessary to supply energy from outside.

Since the heat pipes 41 are buried in the peripheral wall of the pump housing 10 which surrounds the operating chambers 31 and 32, the heat transmitting system high in efficiency can be formed with ease.

Now, second, third and fourth embodiments of the invention will be described in the other drawings, in which parts corresponding functionally to those already described with reference to the first embodiments are therefore designated by the same reference numerals or characters. That is, the parts of the second through fourth embodiments which are different from those of the first embodiment will be mainly described.

Second Embodiment

Figure 3:
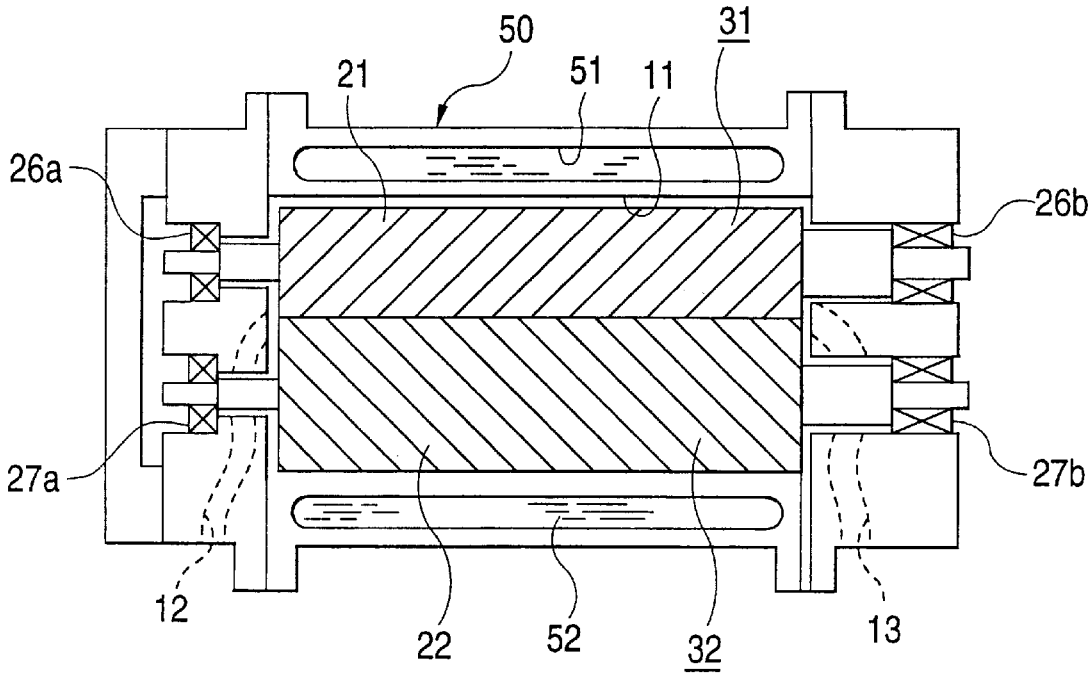
FIG. 3 is a sectional front view showing the arrangement of another example of the positive displacement pump, which is a second embodiment of the invention.

FIG. 3 is a diagram showing the arrangement of another example of the positive displacement pump, which constitutes a second embodiment of the invention.

In FIG. 3, reference numeral 50 designates a pump housing in which a predetermined heat-circulating operating fluid (or thermal conduction fluid) is sealingly filled. The pump housing 50 has a single or plural thermal conduction fluid chambers 51 (heat transmitting system) which are extended over at least a predetermined distance as viewed in the direction of axis of the rotor. The fluid 52 in the thermal conduction fluid chamber utilizes its convection or forcible circulation to moved the heat to the vicinity of the suction inlet 12 which is produced by the heat-insulation compression in the portions of the operating chambers 31 and 32 which are located near the discharge outlet. Thus, the second embodiment has substantially the same effects as the above-described first embodiment.

Third Embodiment

Figure 4:
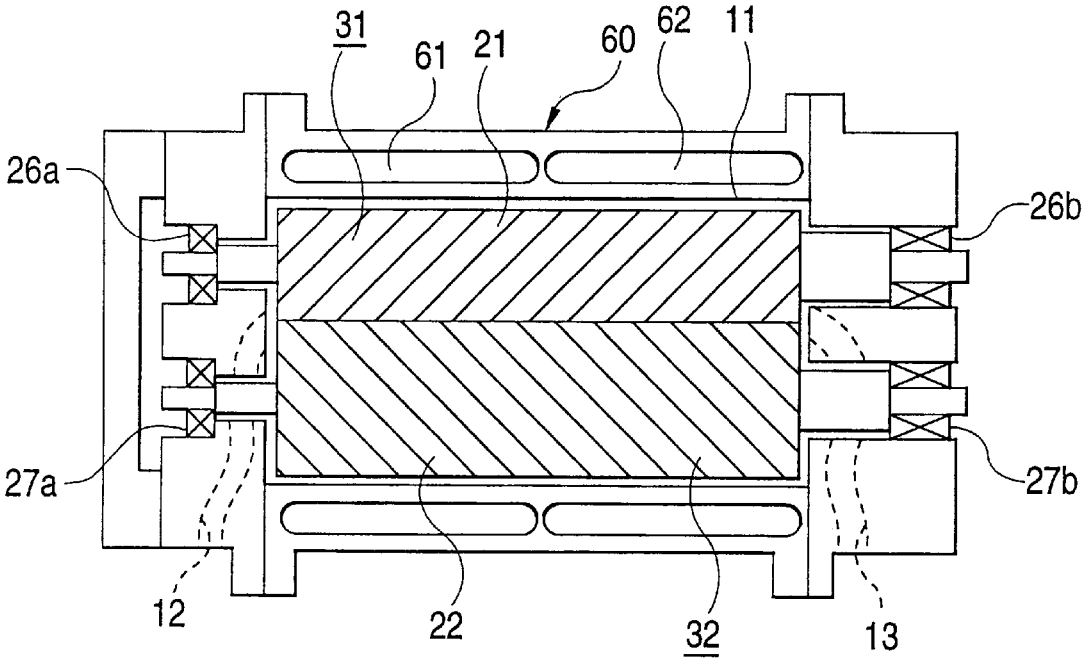
FIG. 4 is a sectional front view showing the arrangement of another example of the positive displacement pump, which is a third embodiment of the invention.

FIG. 4 is a diagram showing the arrangement of another example of the positive displacement pump, which constitutes a third embodiment of the invention.

In FIG. 4, reference numeral 60 designates a pump housing. The latter 60 accommodates a heater 61 in such a manner that the latter 61 surrounds the operating chambers 31 and 32 on the suction side, and a cooler 62 in such a manner that the latter 62 surrounds the operating chambers 31 and 32 on the discharge side. The heater 61 is, for instance, a nichrome wire heater or band heater, and is adapted to generate electrical heat. The cooler 62 is made up of radiating fins or cooling-solution circulating paths. The heater 61 functions as follows: When the temperature on the discharge side becomes excessively high, the cooler 62 is activated in response to a signal from a temperature sensor (not shown).

As is apparent from the above description, with the heater 61 and the cooler 62 the temperature on the side of the suction inlet 12 and the temperature on the side of the discharge outlet 13 can be maintained in predetermined ranges, respectively. Thus, the third embodiment has substantially the same effects as the above-described embodiments.

The third embodiment shown in FIG. 4 may be modified as follows: That is, the cooler 62 may be dispensed with, and the heater 61 on the suction side may be formed by winding a nichrome wire or band heater on the pump housing 60.

Fourth Embodiment

Figure 5:
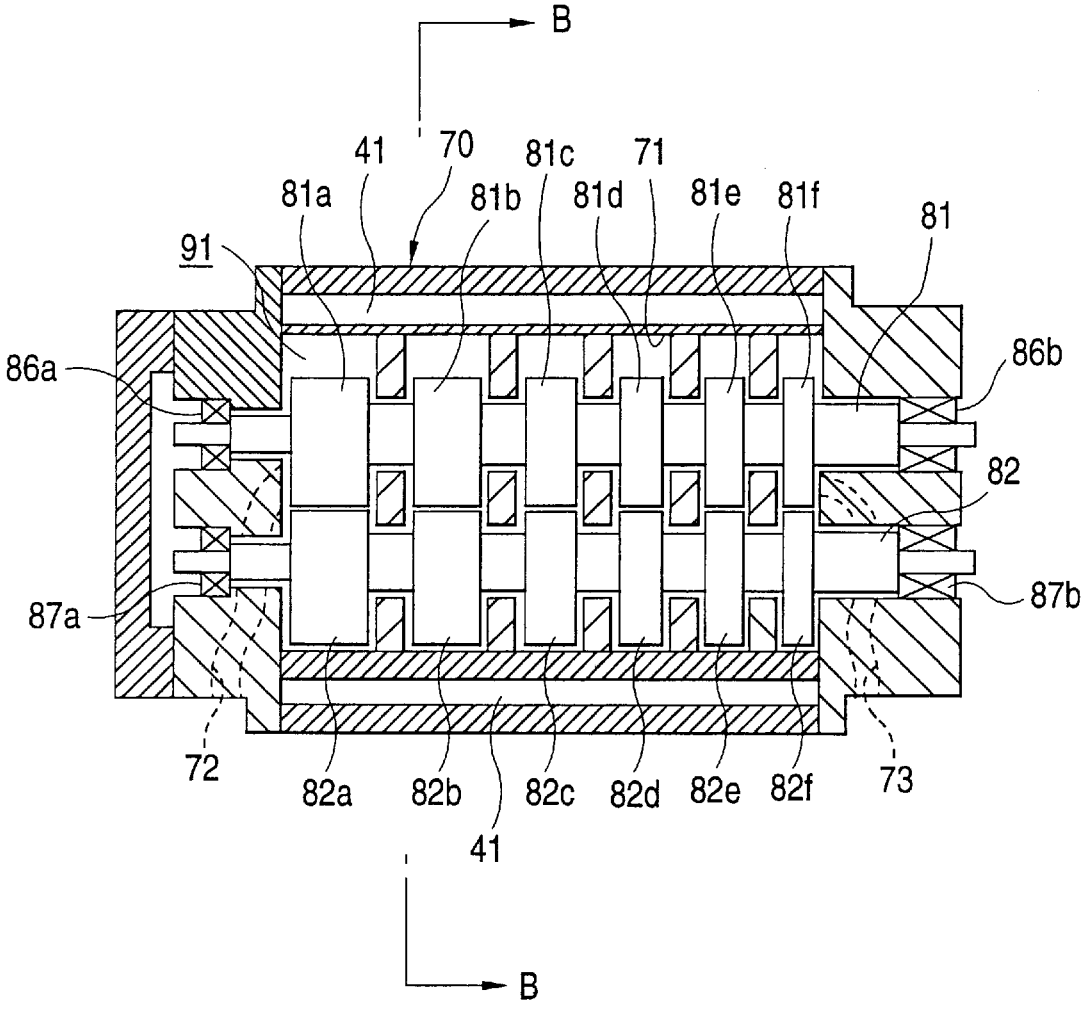
FIG. 5 is a sectional front view showing the arrangement of another example of the positive displacement pump, which is a fourth embodiment of the invention.
Figure 6:
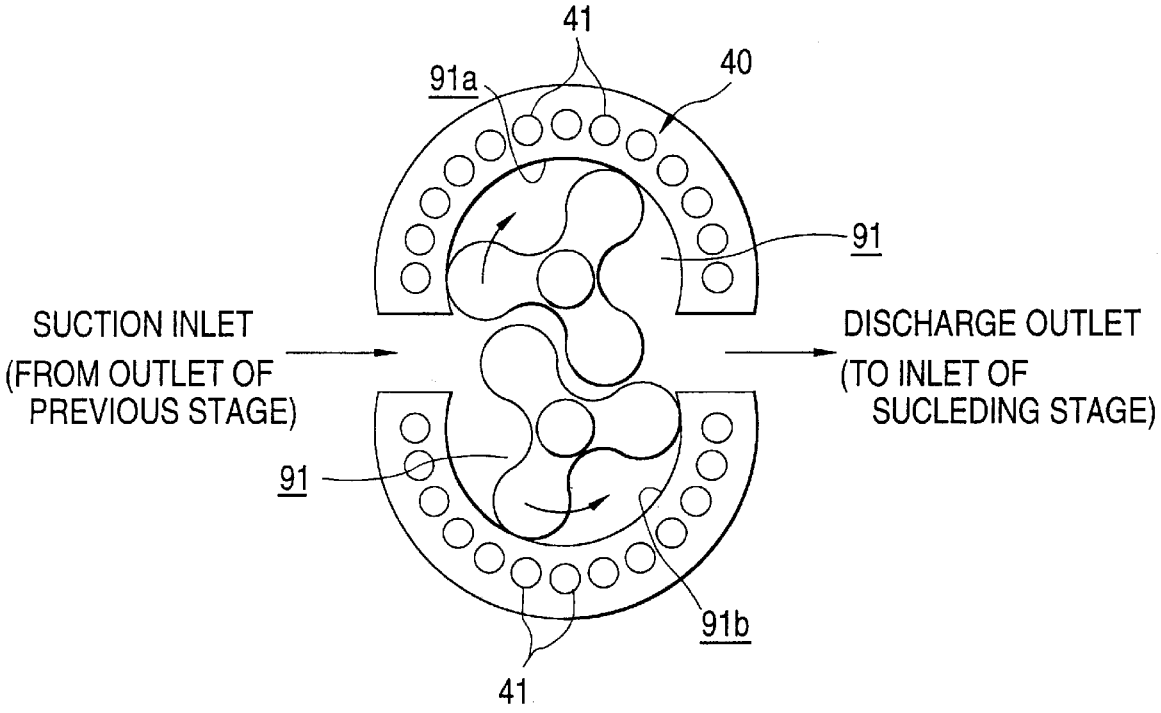
FIG. 6 is a sectional view taken along line B—B in FIG. 5.

FIGS. 5 and 6 are diagrams showing another example of the positive displacement pump, which constitutes a fourth embodiment of the invention. In the fourth embodiment, the technical concept of the invention is applied to a root type pump which is formed as a multi-stage pump.

In FIGS. 5 and 6, reference numeral 70 designates a pump housing. The latter 70 includes an inner chamber 71, and a suction inlet 72 on one end and a discharge outlet 73 on the other side both of which are communicated with the chamber 71. Reference numerals 81 and 82 designate a pair of rotors which are accommodated in the pump housing 70 in such a manner that they are adjacent to each other and are in parallel with each other. The rotors 81 and 82 have a plurality of rotor sections 81*a* through 81*f* and a plurality of rotor sections 82*a* through 82*f*, respectively, in correspondence to the number of stages of the multi-stage pump, thus forming shifting operating-chambers with the pump housing 70 in correspondence to the number of stages of the multi-stage pump. Hereinafter, the pump operating chamber of each stage will be described as an operating chamber 91 shown in FIG. 6. As shown in FIG. 6, the rotors 81 and 82 increase the volume of the operating chamber 91 in the shifting interval on the suction side which communicates with the side of the suction inlet 72, and then divide it into an operating chamber 91*a* on the side of the rotor 81 and an operating chamber 91*b* on the side of the rotor 82, and form those chambers into the operating chamber 91 to reduce the volume thereof. The term "the side of the suction inlet 72" as used herein is intended to mean the suction inlet side of the pump stage which communicates with the suction inlet 72 or the discharge outlet of the pump stage of the side of the suction inlet 72, and the term "the side of the discharge outlet 73 as used herein is intended to mean the discharge outlet side of the pump stage which communicates with the discharge outlet 73 or the suction inlet of the pump stage of the side of the discharge outlet 73.

Inside the pump housing 70 (for instance, between the adjacent operating chambers 91 as viewed in the direction of axes of the rotors) a communication path is formed through which the discharge outlet of the front stage communicates with the suction inlet of the rear stage which is spaced 180° as viewed in the direction of rotation of the rotors. The plurality of rotor sections 81*a* through 81*f* are gradually decreased in width from first ends of the rotor 81 and 82 towards the remaining second ends; that is, among the operating chambers 91 at the pump stage, the operating chambers 91 at the last stage nearest to the discharge outlet 73 is smallest in volume.

In the fourth embodiment, the pump is a multi-stage pump. Hence, the fluid discharged from the discharge outlet of the front stage pump is sucked into the suction inlet of the rear stage pump which is spaced 180° as viewed in the direction of rotation of the rotors. Hence, in the direction of rotation of the rotors the pump is relatively unified in temperature distribution, and the temperature is gradually increased towards to the rear stage side as viewed in the direction of axis of the rotor; that is, the temperature is increased as the degree of compression of the internal fluid increases. In other words, in the multi-stage pump, the side of the discharge outlet 73 is high in temperature, while the side of the suction inlet 72 is low in temperature. Accordingly, the temperature control system is provided which controls the temperature difference between the suction inlet 72 and the discharge outlet 73 in a predetermined range. That is, in order to transmit the heat from the vicinity of the discharge outlet 73 to the vicinity of the suction inlet 72, a plurality of heat pipes 41 are arranged parallel in the peripheral wall 75 of the pump housing 70 which surround the operating chambers 91.

If, in the case where the pump is such that the rotors shift the operating chambers around the axis of rotation, the pump is a multi-stage pump extended in the direction of axis of the rotors, then the heat transmitting system can be employed which are extended in the direction of axis of the rotors; however, the invention is not limited thereto or thereby. In the case where the pump is not a multi-stage pump, a system for transmitting heat from the discharge side to the suction side which are spaced in the direction of rotation of the rotor may be employed; for instance, heater pipes which are arcuately curved so as to extend in the direction of rotation of the rotors may be buried in the pump housing, or a circulation path for a fluid high in thermal conductivity is formed in the pump housing. Those system may be suitably combined with each other to effectively transmit the compression heat from the discharge side to the suction side. In addition, the temperature control system may be buried in the rotor side instead of the pump housing.

Effect(s) of the Invention

The positive displacement pump of the invention has the temperature control system for controlling the temperature of the operating chambers which are located on the side of the suction inlet. Therefore, heat can be suitably applied to the side of the suction inlet. As a result, on the suction side of the pump, the temperature can be controlled to a value with which, for instance, it is difficult to form solid products from the reaction gas.

Furthermore, in the case where the aforementioned temperature control system is the heat transmitting system which is provided in the pump housing and/or the rotors to transmit heat from the vicinity of the discharge outlet to the vicinity of the suction inlet, the compression heat on the discharge side is effectively utilized which makes it unnecessary to supply energy from outside.

Moreover, in the case where the heat transmitting system is provided in the peripheral wall of the pump housing which surround the operating chambers, the heat transmitting system is high both in maintenance and in reliability, and the compression heat on the discharge side can be transmitted to the suction side with high efficiency.

What is claimed is:

1. A positive displacement pump comprising:

a pump housing having an internal chamber, and a suction inlet and a discharge outlet communicated with said internal chamber;

rotors, accommodated in said pump housing, for forming shiftable operating chambers in cooperation with said pump housing, and increasing volume of said operating chambers in a shift interval which communicates with said suction inlet while decreasing volume of said operating chambers in a shift interval which communicated with said discharge outlet; and a temperature control system for controlling temperature on a side of said suction inlet, the temperature control system including a plurality of heat pipes in each of which a predetermined liquid and pressure-decreased gas are sealingly provided.

2. A positive displacement pump as claimed in claim 1, wherein said temperature control system is a heat transmitting system which is provided in at least one of said pump housing and said rotors to transmit heat from the vicinity of said discharge outlet to the vicinity of said suction inlet.

3. A positive displacement pump as claimed in claim 2, wherein said heat transmitting system is provided in a peripheral wall of said pump housing which surrounds said operating chambers.

4. A positive displacement pump comprising:

a pump housing having an internal chamber, and a suction inlet and a discharge outlet communicated with said internal chamber;

rotors, accommodated in said pump housing, for forming shiftable operating chambers in cooperation with said pump housing, and increasing volume of said operating chambers in a shift interval which communicates with said suction inlet while decreasing volume of said operating chambers in a shift interval which communicated with said discharge outlet; and a temperature control system for controlling temperature on a side of said suction inlet, the temperature control system including at least one thermal conduction fluid chamber in which fluid is sealingly provided and circulates heat.

5. A positive displacement pump comprising:

a pump housing having an internal chamber, and a suction inlet and a discharge outlet communicated with said internal chamber;

rotors, accommodated in said pump housing, for forming shiftable operating chambers in cooperation with said pump housing, and increasing volume of said operating chambers in a shift interval which communicates with said suction inlet while decreasing volume of said operating chambers in a shift interval which communicated with said discharge outlet; and a temperature control system for controlling temperature on a side of said suction inlet, the control system including a cooler and a heater.

6. A positive displacement pump comprising:

a pump housing having an internal chamber, and a suction inlet and a discharge outlet communicated with said internal chamber;

rotors, accommodated in said pump housing, for forming shiftable operating chambers in cooperation with said pump housing, and increasing volume of said operating chambers in a shift interval which communicates with said suction inlet while decreasing volume of said operating chambers in a shift interval which communicated with said discharge outlet; and a temperature control system for controlling temperature on a side of said suction inlet, the control system including a heater and a heat sensor for controlling the operation of the heater.

7. The positive displacement pump of claim 6 wherein the control system further includes a cooler.

8. The positive displacement pump of claim 1, wherein said plurality of heat pipes extend generally parallel to the axis of the rotor for transferring heat from the area of the discharge outlet to the area of the suction inlet.

* * * * *